US011787012B2

(12) United States Patent
Shen et al.

(10) Patent No.: US 11,787,012 B2
(45) Date of Patent: Oct. 17, 2023

(54) CONDITIONER DISK, CHEMICAL MECHANICAL POLISHING DEVICE, AND METHOD

(71) Applicant: Taiwan Semiconductor Manufacturing Co., Ltd., Hsinchu (TW)

(72) Inventors: Hsien Hua Shen, Hsinchu (TW); Hsun-Chung Kuang, Hsinchu (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 125 days.

(21) Appl. No.: 17/038,465

(22) Filed: Sep. 30, 2020

(65) Prior Publication Data

US 2021/0129288 A1 May 6, 2021

Related U.S. Application Data

(60) Provisional application No. 62/929,050, filed on Oct. 31, 2019.

(51) Int. Cl.
*B24B 53/017* (2012.01)
*B24B 53/12* (2006.01)

(52) U.S. Cl.
CPC ..... *B24B 53/017* (2013.01); *B24B 53/12* (2013.01)

(58) Field of Classification Search
CPC ..... B24B 53/12; B24B 53/01; B24B 53/017; B24B 53/02; B24B 53/095
USPC ..... 451/56
See application file for complete search history.

(56) References Cited

U.S. PATENT DOCUMENTS

2002/0039880 A1* 4/2002 Torii ..... B24B 53/12 451/72
2003/0013381 A1* 1/2003 Benner ..... B24B 53/017 451/21
2003/0190874 A1* 10/2003 So ..... B24B 57/02 451/56
2004/0110453 A1* 6/2004 Barnett, III ..... B24B 53/12 451/444
2007/0167117 A1* 7/2007 Moon ..... B24B 53/017 451/72

FOREIGN PATENT DOCUMENTS

JP 4855571 B2 * 1/2012

* cited by examiner

*Primary Examiner* — Joel D Crandall
*Assistant Examiner* — Tyler James McFarland
(74) *Attorney, Agent, or Firm* — SEED IP LAW GROUP LLP

(57) ABSTRACT

A pad conditioner for conditioning a polishing surface of a polishing pad includes a conditioning disk, a disk holder, and a disk arm. The conditioning disk includes a substrate plate and at least two abrasive segments. The conditioning disk includes at least one channel by which debris and spent slurry may be evacuated. The abrasive segments are on a surface of the substrate plate, and form at least one channel segment therebetween. Each channel segment extends from about the center of the surface to substantially the outer rim of the substrate plate. The disk holder to which the conditioning disk is mounted includes a through hole. The disk arm to which the conditioning disk is mounted includes an opening in fluid communication with the at least one channel segment via the through hole for evacuating the debris and spent slurry by a vacuum module.

20 Claims, 5 Drawing Sheets

CONDITIONER DISK, CHEMICAL MECHANICAL POLISHING DEVICE, AND METHOD

PRIORITY CLAIM AND CROSS-REFERENCE

This application claims the benefit of priority to U.S. Provisional Application Ser. No. 62/929,050, entitled "CMP Conditioner Disk Design for Reducing Particle and Diamond Scratch Defects," filed on Oct. 31, 2019, which application is incorporated by reference herein in its entirety.

BACKGROUND

Chemical Mechanical Polishing (CMP) is a common process in the formation of integrated circuits. Typically, CMP is used for the planarization of semiconductor wafers. CMP involves the use of a polishing pad affixed to a polishing table, and a wafer holder to press the silicon wafer face-down against the surface of the polishing pad. A polishing slurry containing abrasive and chemical additives is dispensed onto the surface of the polishing pad and used to remove irregularities from the surface of the wafer through both mechanical and chemical means. CMP is an effective way to achieve global planarization of wafers.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
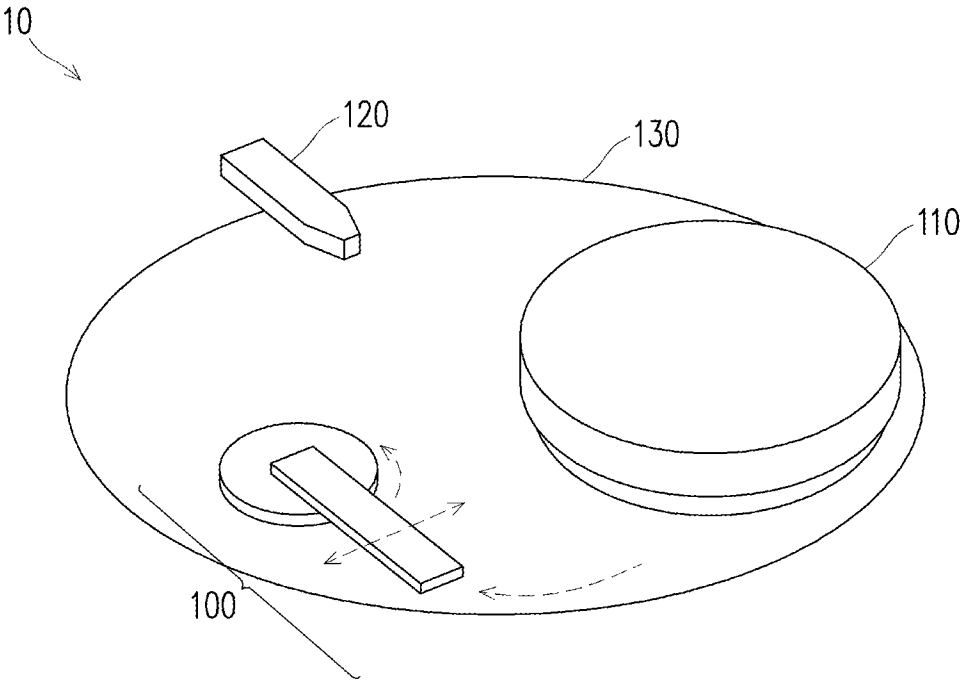
FIG. 1 is a diagram of a CMP device in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

After one or more wafers have been polished, abrasive particles in the polishing slurry or ground-off particles from the wafers are attached to the surface of the polishing pad. Thus, after the polishing pad has been used for a certain period of time, the polishing performance and efficiency are reduced due to accumulation of debris produced in the polishing process on the surface of the polishing pad. A pad conditioner is used to condition the surface of the polishing pad, such that the surface of the polishing pad is re-roughened and maintained at an optimum condition for polishing. A pad conditioner normally contains diamond grits that are attached to an alloy substrate using electrochemical deposition methods.

The conditioning (or, dressing) of the polishing pad may be usually performed in two ways, namely in-situ or ex-situ conditioning. During in situ conditioning, the polishing pad is conditioned simultaneously with the wafer polishing, whereas in the case of ex situ conditioning, the polishing pad is conditioned only after the wafer being polishing and between the wafer polishing cycles. Comparing to the ex-situ conditioning, the in-situ conditioning provides advantages of improved throughput and removal rate stability. Ex-situ conditioning, on the other hand, generally provides better defect performance.

A pad conditioner configured to be used in an in-situ, ex-situ, or continuous-in-process ("CIP"), conditioning operation is provided in the present disclosure. The pad conditioner allows continuously cleaning and evacuating debris and spent slurry from the polishing surface of a polishing pad, thereby helping to reduce defect formation on the surface of a wafer being polished. The debris and spent slurry are evacuated through at least one channel in a conditioning disk of the pad conditioner by a vacuum module attached to the pad conditioner.

FIG. 1 is a diagram of a CMP device 10 in accordance with some embodiments. CMP device 10 includes polishing pad 130, wafer holder 110, slurry arm 120 and pad conditioner 100. CMP device 10 is generally configured for planarizing and polishing surfaces of semiconductor wafers.

Wafer holder 110 presses a semiconductor wafer face-down against the surface of polishing pad 130. Polishing slurry is dispensed onto the surface of the polishing pad by slurry arm 120. Irregularities on the surface of the semiconductor wafer are removed by mechanical and chemical means as polishing pad 130 carrying polishing slurry passes under and rubs against the surface of the semiconductor wafer.

Pad conditioner 100 conditions, or "dresses," polishing pad 130. Pad conditioner is configured to rotate to re-roughen the surface of polishing pad 130, and to translate inward and outward along a radius of polishing pad 130 to reach various central or peripheral regions of polishing pad 130. Pad conditioner 100 continuously cleans and evacuates debris and spent slurry from the polishing surface of polishing pad 130, thereby helping to reduce defect formation on the surface of the semiconductor wafer being polished. The debris and spent slurry are evacuated through at least one channel shown in FIG. 2 in a conditioning disk of pad conditioner 100 by a vacuum module attached to pad conditioner 100.

Figure 2:
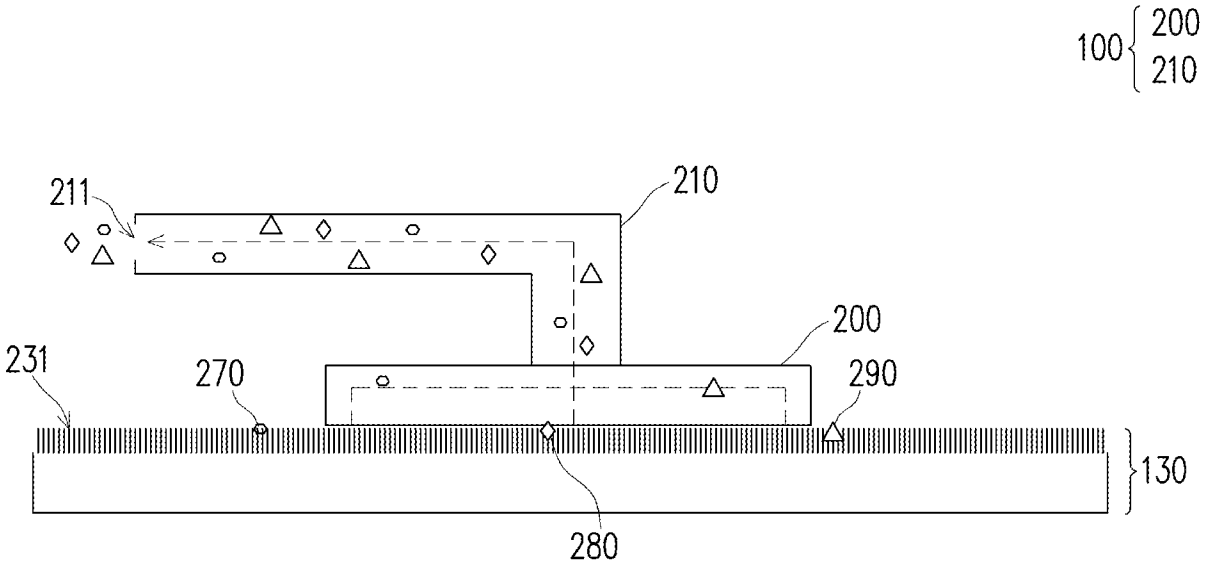
FIG. 2 is a diagram of a pad conditioner and polishing pad of the CMP device in accordance with some embodiments.

FIG. 2 is a diagram of pad conditioner 100 and polishing pad 130 of CMP device 10 in accordance with some embodiments. In some embodiments, polishing pad 130 rotates at about 120 rotations per minute ("rpm") to about 140 rpm. In some embodiments, polishing pad 130 rotates at about 130 rpm. Rotating polishing pad 130 at a higher rate may improve wafer throughput by increasing removal rate of irregularities on the surface of the semiconductor wafer. Rotating polishing pad 130 at a slower rate may improve uniformity of polishing across the surface of the semiconductor wafer.

As the semiconductor wafer is polished, debris including abrasive particles 270 in the polishing slurry, ground-off particles 290 from the semiconductor wafer, or even abrasive particles 280 from the pad conditioner 100 attaches to surface 231 of polishing pad 130. Pad conditioner 100, by removing the debris and spent slurry, retains polishing performance and efficiency of polishing pad 130 continuously in process with the polishing process, before or after the polishing process, or in some combination thereof.

Conditioning disk 200 is configured to contact and roughen surface 231 of polishing pad 130. Conditioning disk 200 generally includes abrasive material for roughening surface 231. In some embodiments, the abrasive material is abrasive grits such as diamond grits about 200 micrometers in size.

Conditioning disk 200 further includes at least one channel, illustrated by dashed lines in FIG. 2. Abrasive particles 270, 280 and ground-off particles 290 are able to transit along the at least one channel to be evacuated from surface 231 of polishing pad 130.

Conditioning disk 200 is configured to rotate clockwise or counter-clockwise, with or against rotation direction of polishing pad 130. In some embodiments, conditioning disk 200 rotates at about 110 rpm to about 130 rpm. In some embodiments, conditioning disk 200 rotates slower than polishing pad 130. In some embodiments, conditioning disk 200 rotates at about 120 rpm. Rotating conditioning disk 200 of pad conditioner 100 at a slower rate may improve ability of conditioning disk 200 to trap the abrasive particles 270, 280 and ground-off particles 290 in the at least one channel. The slower rate of rotation of the conditioning disk 200 may further allow for use of gentler vacuuming to evacuate abrasive particles 270, 280 and ground-off particles 290 from surface 231 of polishing pad 130.

Disk arm 210 of pad conditioner 100 is attached to conditioning disk 200. Disk arm 210 translates toward and away from the center of polishing pad 130 to ensure evacuation of abrasive particles 270, 280 and ground-off particles 290 from most or all of surface 231 of polishing pad 130. Opening 211 of disk arm 210 is in fluid communication with the at least one channel of conditioning disk 200 and a vacuum module. Opening 211 is at one end of an internal channel of disk arm 210 illustrated by a dashed line ended with an arrow. Abrasive particles 270, 280 and ground-off particles 290 and spent slurry from surface 231 of polishing pad 130 travel along the at least one channel of conditioning disk 200, through the internal channel of disk arm 210, and are evacuated out of disk arm 210 through opening 211.

Figure 3:
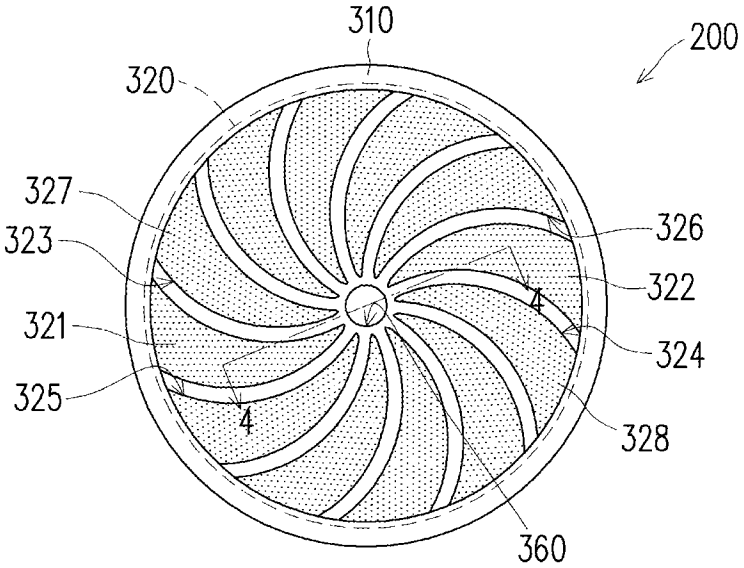
FIG. 3 is a diagram of a conditioning disk in accordance with some embodiments.

FIG. 3 is a diagram of conditioning disk 200 in accordance with some embodiments. Substrate plate 310 of conditioning disk 200 is generally made of a rigid material. In some embodiments, substrate plate 310 comprises or is stainless steel. In some embodiments, diameter of substrate plate 310 is about 90 millimeters to about 130 millimeters. In some embodiments, substrate plate 310 has diameter of about 110 millimeters. A wider substrate plate 310 will be able to roughen a greater surface area of the surface 231 at a time. A narrower substrate plate 310 will be generally lighter, less expensive to manufacture, and allow vacuuming at lower power. Thickness of substrate plate 310 is about 4 millimeters to about 10 millimeters. A thicker substrate plate 310 will provide longer lifespan and resistance to warping. A thinner substrate plate 310 will be generally lighter and less expensive to manufacture. In some embodiments, thickness of substrate plate 310 is about 6 millimeters.

Abrasive region 320 illustrated by a dashed line in FIG. 3 is a region of substrate plate 310 in which patterned abrasive material is attached to substrate plate 310. In some embodiments, single-crystalline diamond grits of length about 200 micrometers are uniformly attached to substrate plate 310 by either electroplating of nickel, brazing with an alloy, or another suitable process.

The patterned abrasive material of abrasive region 320 attached to substrate plate 310 includes abrasive segments 321, 322, 327, 328 and channel segments 323, 324, 325, 326 shown in FIG. 3. Conditioning disk 200 generally includes at least two abrasive segments, and at least one channel segment. In the configuration shown in FIG. 3, adjacent abrasive segments 321, 327 form channel segment 323 therebetween, and adjacent abrasive segments 322, 328 form channel segment 324 therebetween.

In configurations including at least three abrasive segments, each abrasive segment may be abutted by two channel segments. Twelve abrasive segments are shown in FIG. 3. Abrasive segment 321 is abutted on a first side by channel segment 323 and on a second side by channel segment 325. Abrasive segment 322 is abutted on a first side by channel segment 324 and on a second side by channel segment 326.

In some embodiments, the twelve abrasive segments are substantially the same shape. Shape of abrasive segment 321 is described for illustrative purposes. In some embodiments, abrasive segment 321 is fan shaped. The term "fan shaped" may include some characteristics, described following. Abrasive segment 321 is narrower toward the center of abrasive region 320, and wider toward the perimeter of abrasive region 320. Abrasive segment 321 is abutted by non-linear channel segments 323, 325, and abrasive segment 321 has non-linear sides. In some embodiments, non-linear is curved, bent, or the like. Abrasive segments that widen from center regions to peripheral regions, and have non-linear sides, are considered to be "fan shaped" herein. In some embodiments, average radius of curvature of abrasive segment 321 is greater than about half the radius of abrasive region 320.

In some embodiments, the channel segments are extended in a radial direction. In some embodiments, the twelve channel segments are substantially the same shape. Shape of channel segment 323 is described for illustrative purposes. Channel segment 323 extends from about the center of abrasive region 320 to the outer edge of abrasive region 320. In the configuration shown in FIG. 3, channel segment 323 is non-linear. In some embodiments, channel segment 323 is curved. In some embodiments, average radius of curvature of channel segment 323 is greater than about half the radius of abrasive region 320. In some embodiments, average radius of curvature of channel segment 323 is substantially the same as average radius of curvature of abrasive segment 321 and abrasive segment 327. Curved channel segment 323 promotes fluid flow toward the center of abrasive region 320 and hole 360, allowing for improved debris and slurry evacuation and/or use of a gentler vacuum.

Channel segment 323 generally includes less abrasive material per unit area than abrasive segment 321. Channel segment 323 may be considered a groove in abrasive region 320. In some embodiments, channel segment 323 is devoid of abrasive material, such that the surface of substrate plate 310 in channel segment 323 is covered by substantially no abrasive material. It may be advantageous to have substantially no abrasive material covering substrate plate 310 in the region of channel segment 323 to promote fluid flow through channel segment 323. In some embodiments, channel segment 323 has at least 10 times less, at least 100 times less, or at least 1000 times less concentration of abrasive material than abrasive segment 321. While it may be generally desirable to have substantially no abrasive material in channel segment 323, in some fabrication processes, to save cost, it may be advantageous to have as little abrasive material in channel segment 323 as possible without requiring complete removal or absence thereof. It may also be desirable to have some thin layer of abrasive material in channel segment 323 to protect the material of substrate plate 310 from degradation in the presence of the slurry.

In some embodiments, the channel segments occupy from about 10% to about 50% of the surface area of substrate plate 310. It may be advantageous to have a lower percentage of substrate plate 310 covered by channel segments, and thereby a greater percentage of substrate plate 310 covered by abrasive material, to promote loosening of debris from the polishing pad 130. Too narrow or too few channel segments may provide insufficient collection, motion and evacuation of the debris from the polishing pad 130, or may lead to blockage in the channel segments.

In some embodiments, sidewalls of channel segment 323 are substantially vertical. Sidewalls that are "vertical" may be substantially linear and oriented substantially parallel to the normal of the surface of the substrate plate 310 on which surface abrasive region 320 is attached. In some embodiments, sidewalls of channel segment 323 are tapered. Sidewalls that are "tapered" may be substantially linear and oriented at an offset angle less than 90 degrees from the normal of the surface of the substrate plate 310 on which surface abrasive region 320 is attached. Sidewalls that are vertical or tapered may be easier to manufacture, and provide best process uniformity. In some embodiments, sidewalls of channel segment 323 are concave. Sidewalls that are "concave" may be substantially curved so as to form a U-shaped cross-section. Sidewalls that are tapered or concave may promote better capture of debris, as debris may collect in regions having greater angularity.

In some embodiments, a first sidewall of channel segment 323 has different shape from a second sidewall of channel segment 323. In some embodiments, the first sidewall is vertical and the second sidewall is concave. Depending on direction of rotation of conditioning disk 200, it may be advantageous to have vertical sidewalls on a first side of the channel segments, and tapered or concave sidewalls on a second side of the channel segments.

In some embodiments, sidewalls of channel segment 323 have varying shape depending on proximity to the center of the surface of substrate plate 310 on which surface abrasive segments are attached. In the configuration shown in FIG. 3, debris and spent slurry generally flow from the perimeter of abrasive region 320 toward hole 360 at the center of substrate plate 310. In some embodiments, sidewalls of channel segment 323 are more vertical near the center, and more concave or tapered further from the center. This may be advantageous to provide greater channel segment cross-sectional area nearer hole 360, and less debris trapping at the perimeter.

Figure 4:
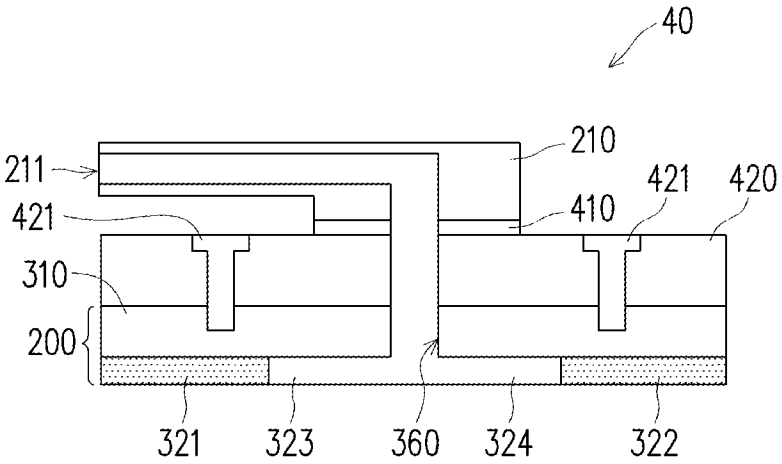
FIG. 4 is a cross-section of a pad conditioner including the conditioning disk of FIG. 3 in accordance with some embodiments.

FIG. 4 is a cross-section of pad conditioner 40 including conditioning disk 200 of FIG. 3 in accordance with some embodiments. Conditioning disk 200 is attached to disk arm 210 by disk holder 420. In some embodiments, disk holder 420 has substantially similar diameter as pad conditioner 200. In some embodiments, disk holder 420 has greater diameter than pad conditioner 200. Disk holder 420 is attached to pad conditioner 200 by at least one fastener 421 extending through disk holder 420 and at least partially through substrate plate 310 of conditioning disk 200. In some embodiments, disk holder 420 is attached to pad conditioner 200 by at least two fasteners 421. Use of at least two fasteners 421 provides more secure attachment to pad conditioner 200. Utilization of disk holder 420 allows for pad conditioner 200 to be manufactured as a consumable part which can be replaced when wear of abrasive material of abrasive region 320 reaches a predetermined level. In some embodiments, the predetermined level is a thickness of abrasive material in abrasive region 320 lower than a predetermined thickness. The predetermined thickness may be chosen to be a thickness at which conditioning performance is no longer sufficient to prevent scratching of the wafer surface by debris and spent slurry. In some embodiments, pad conditioner 200 is integrally formed with disk arm 210 as a single assembly that is replaced entirely when wear of abrasive material of abrasive region 320 reaches the predetermined level as described above.

Actuator 410 is attached to disk arm 210 and disk holder 420, and is configured to provide force that rotates conditioning disk 200 attached to disk holder 420. In some embodiments, actuator 410 includes at least a direct current (DC) motor for providing the force. In some embodiments, actuator controls at least rotation direction and rotation speed of conditioning disk 200.

Disk arm 210 includes an inner channel extending along the lengthwise direction of disk arm 210 and in fluid communication with hole 360 in substrate plate 310 and disk holder 420. Opening 211 of the inner channel in disk arm 210 is coupled to a vacuum module.

Pad conditioner 40 is configured to be used in an in-situ, ex-situ, or continuous-in-process ("CIP"), conditioning operation. Pad conditioner 40 allows continuously cleaning and evacuating debris and spent slurry from the polishing surface of polishing pad 130, thereby helping to reduce defect formation on the surface of a wafer being polished. The debris and spent slurry are evacuated through channel segments 323, 324 between abrasive segments 321, 327 and abrasive segments 322, 328, respectively, in conditioning disk 200 of pad conditioner 40 by a vacuum module attached to pad conditioner 40. The inner channel in disk arm 210 and hole 360 in substrate plate 310 and disk holder 420 constitute an evacuation channel through which the spent slurry and debris entrapped in the grooves 323, 324 between the abrasive segments 321, 327, 322, 328 can be removed by the vacuum module during the in-situ conditioning of polishing pad 130. As a result, the scratching of the wafer surface caused by the polishing debris and spent slurry is reduced or eliminated.

Figure 6:
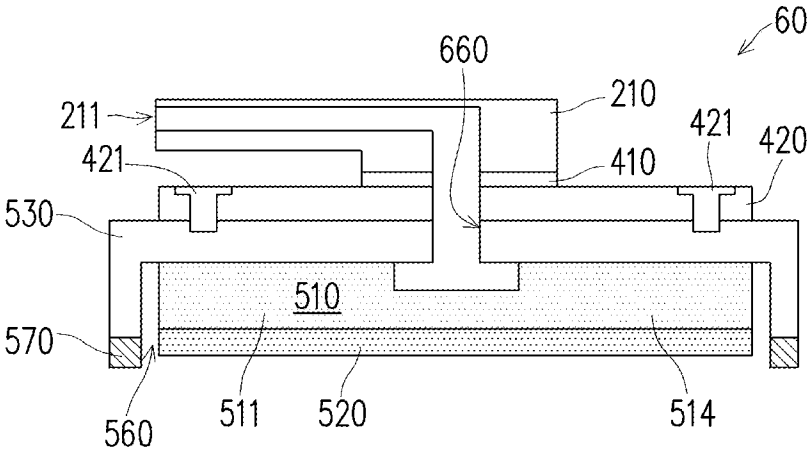
FIG. 6 is a cross-section of a pad conditioner including the conditioning disk of FIG. 5 in accordance with some embodiments.
Figure 7:
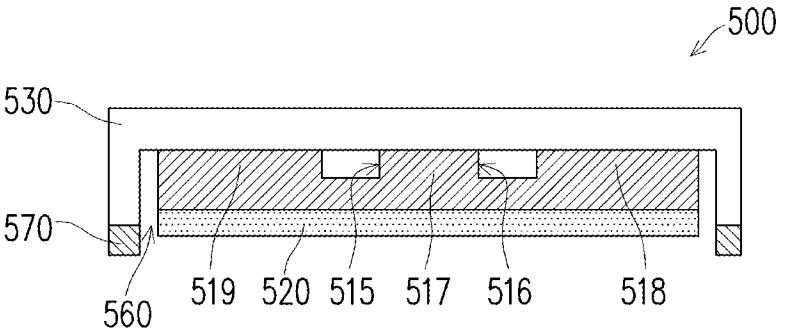
FIG. 7 is a cross-section of the conditioning disk of FIG. 5 in accordance with some embodiments.
Figure 5:
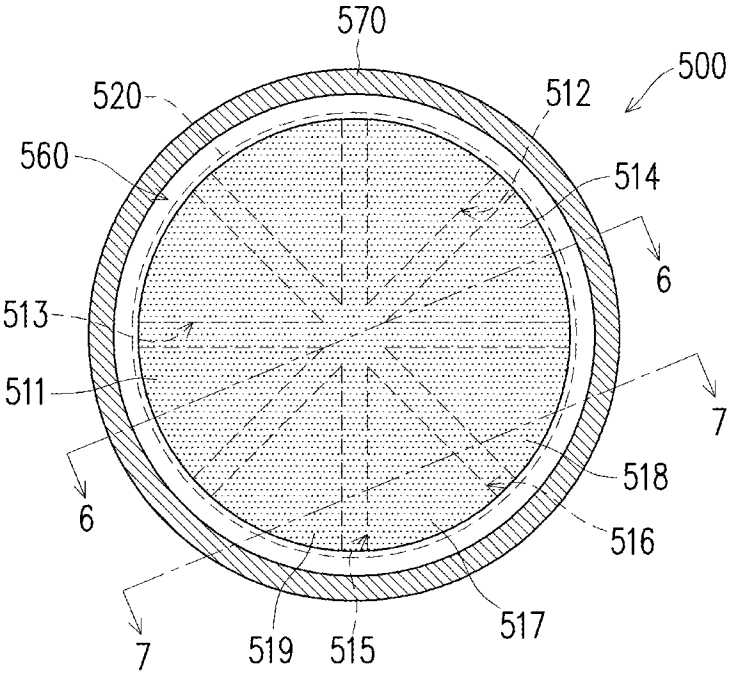
FIG. 5 is a diagram of a conditioning disk in accordance with some embodiments.

FIG. 5 is a diagram of conditioning disk 500 in accordance with some embodiments. FIG. 6 is a cross-section of conditioning disk 500 along cross-sectional line 6-6 of FIG. 5 in accordance with some embodiments. FIG. 7 is another cross-section of conditioning disk 500 along cross-sectional line 7-7 of FIG. 5 in accordance with some embodiments.

Substrate plate 510 of conditioning disk 500 is generally made of a rigid material. In some embodiments, substrate plate 510 comprises or is stainless steel. In some embodiments, diameter of substrate plate 510 is about 90 millimeters to about 130 millimeters. In some embodiments, substrate plate 510 has diameter of about 110 millimeters. A wider substrate plate 510 will be able to roughen a greater surface area of the surface 231 at a time. A narrower substrate plate 510 will be generally lighter, less expensive to manufacture, and allow vacuuming at lower power. Thickness of substrate plate 510 is about 4 millimeters to about 10 millimeters. A thicker substrate plate 510 will provide longer lifespan and resistance to warping. A thinner substrate plate 510 will be generally lighter and less expensive to manufacture. In some embodiments, thickness of substrate plate 510 is about 6 millimeters. In some embodiments, substrate plate 510 is substantially free of through holes. In some embodiments, an underside of substrate plate 510 is not in fluidic communication with a topside of substrate plate 510 through substrate plate 510. Fluid at the underside generally will reach the topside by flowing outward to the outside of substrate plate 510, climbing the outer wall of substrate plate 510, and flowing inward over the topside of substrate plate 510.

Abrasive region 520 illustrated by a dashed line in FIG. 5 is a region of substrate plate 510 in which abrasive material is attached to substrate plate 510. In some embodiments, single-crystalline diamond grits of length about 200 micrometers are uniformly attached to substrate 510 by either electroplating of nickel, brazing with an alloy, or another suitable process. In some embodiments, as shown in FIG. 5, abrasive region 520 is continuous, having similar thickness across the underside of substrate plate 510 facing polishing pad 130.

The topside of substrate plate 510 includes topside segments 511, 514, 517, 518, 519 and channel segments 512, 513, 515, 516 shown in FIG. 5. Conditioning disk 500 generally includes at least two topside segments, and at least one channel segment. In the configuration shown in FIG. 5, adjacent topside segments 517, 519 form channel segments 515 therebetween, and adjacent topside segments 517, 518 form channel segment 516 therebetween.

In configurations including at least three topside segments, each topside segment may be abutted by two channel segments. Eight topside segments are shown in FIG. 5. Topside segment 517 is abutted on a first side by channel segment 515 and on a second side by channel segment 516.

In some embodiments, the eight topside segments are substantially the same shape. Shape of topside segment 517 is described for illustrative purposes. In some embodiments, topside segment 517 is wedge shaped. The term "wedge shaped" may include some characteristics, described following. Topside segment 517 is narrower toward the center of abrasive region 510, and wider toward the perimeter of abrasive region 520. Topside segment 517 is abutted by linear channel segments 515, 516, and topside segment 517 has linear sides. Linear refers to generally straight lines free of curves, bends, or the like. Topside segments that widen from center regions to peripheral regions, and have linear sides, are considered to be "wedge shaped" herein.

In some embodiments, the eight channel segments are substantially the same shape. Shape of channel segment 513 is described for illustrative purposes. Channel segment 513 extends from about the center of substrate plate 510 to the outer edge of substrate plate 510. In the configuration shown in FIG. 5, channel segment 513 is linear. Straight channel segment 513 promotes fluid flow from the perimeter of substrate plate 510 inward, allowing for improved debris and slurry capture by retaining ring 570 and evacuation through gap 560 and hole 660, and out through opening 211.

Each channel segment, such as channel segment 513, may be considered a groove in substrate plate 510. An underside of middle plate 530 facing the topside of substrate plate 510 forms ceilings of channel segments 515, 516. In some embodiments, the channel segments occupy from about 10% to about 50% of the surface area of the topside of substrate plate 510. It may be advantageous to have a lower percentage of substrate plate 510 covered by channel segments to allow for use of a relatively lower vacuum power. Too narrow or too few channel segments may provide insufficient collection or may lead to blockage in the channel segments.

In some embodiments, sidewalls of channel segment 513 are substantially vertical. Sidewalls that are "vertical" may be substantially linear and oriented substantially parallel to the normal of the topside surface of the substrate plate 510. In some embodiments, sidewalls of channel segment 513 are tapered. Sidewalls that are "tapered" may be substantially linear and oriented at an offset angle less than 90 degrees from the normal of the topside surface of the substrate plate 510. Sidewalls that are vertical or tapered may be easier to manufacture, and provide best process uniformity. In some embodiments, sidewalls of channel segment 513 are concave. Sidewalls that are "concave" may be substantially curved so as to form a U-shaped cross-section. Sidewalls that are tapered or concave may promote better capture of debris, as debris may collect in regions having greater angularity.

In some embodiments, a first sidewall of channel segment 513 has different shape from a second sidewall of channel segment 513. In some embodiments, the first sidewall is vertical and the second sidewall is concave. Depending on direction of rotation of conditioning disk 500, it may be advantageous to have vertical sidewalls on a first side of the channel segments, and tapered or concave sidewalls on a second side of the channel segments.

In some embodiments, sidewalls of channel segment 513 have varying shape depending on proximity to the center of the surface of substrate plate 510 on which surface topside segments are attached. In the configuration shown in FIG. 5, debris and spent slurry generally flow from the center of abrasive region 520 toward the perimeter of substrate plate 510. In some embodiments, sidewalls of channel segment 513 are more vertical near the perimeter, and more concave or tapered further from the perimeter. This may be advantageous to provide greater channel segment cross-sectional area nearer gap 560, and less debris trapping at the center.

FIG. 6 is a cross-section of pad conditioner 60 including conditioning disk 500 of FIG. 5 in accordance with some embodiments. Conditioning disk 500 further includes middle plate 530. Middle plate 530 is attached to the topside of substrate plate 510, and surrounds sidewalls of substrate plate 510 with gap 560 therebetween. Retaining ring 570 is attached to middle plate 530, and extends vertically below the underside of substrate plate 510. Gap 560 is in fluid communication with opening 211 through channel segments (e.g., channel segments 515, 516), and hole 660 in middle plate 530 and disk holder 420. The debris and spent slurry are evacuated through channel segments 515, 516, gap 560, hole 660 and the inner channel of disk arm 210 by a vacuum module attached to opening of disk arm 210 of pad conditioner 60. The inner channel in disk arm 210, hole 660 in disk holder 420 and middle plate 530, channel segments (e.g., channel segments 515, 516), and gap 560 constitute an evacuation channel through which the spent slurry and debris entrapped in the grooves 515, 516 can be removed by the vacuum module during the in-situ conditioning of polishing pad 130.

Conditioning disk 500 is attached to disk arm 210 by disk holder 420. In some embodiments, disk holder 420 has substantially similar diameter as substrate plate 510. In some embodiments, disk holder 420 has greater or smaller diameter than substrate plate 510. Disk holder 420 is attached to pad conditioner 500 by at least one fastener 421 extending through disk holder 420 and at least partially through middle plate 530 of conditioning disk 500. In some embodiments, disk holder 420 is attached to pad conditioner 500 by at least two fasteners 421. Use of at least two fasteners 421 provides more secure attachment to pad conditioner 500. In some embodiments, middle plate 530 and substrate plate 510 are manufactured as a unitary piece. In other embodiments in which middle plate 530 is attached to substrate plate 510 by, for example, an adhesive, utilization of disk holder 420 and middle plate 530 allows for substrate plate 510 with abrasive region 520 to be manufactured as a consumable part which can be replaced when wear of abrasive material of abrasive region 520 reaches a predetermined level. In either configuration, the predetermined level is a thickness of abrasive material in abrasive region 520 lower than a predetermined thickness. The predetermined thickness may be chosen to be a thickness at which conditioning performance is no longer sufficient to prevent scratching of the wafer surface by debris and spent slurry. In some embodiments, pad conditioner 500 is integrally formed with disk arm 210 as a single assembly that is replaced entirely when wear of abrasive material of abrasive region 520 reaches the predetermined level as described above.

Actuator 410 is attached to disk arm 210 and disk holder 420, and is configured to provide force that rotates conditioning disk 500 attached to disk holder 420. In some embodiments, actuator 410 includes at least a direct current (DC) motor for providing the force. In some embodiments, actuator controls at least rotation direction and rotation speed of conditioning disk 500.

Pad conditioner 60 is configured to be used in an in-situ, ex-situ, or continuous-in-process ("CIP"), conditioning operation. Pad conditioner 60 allows continuously cleaning and evacuating debris and spent slurry from the polishing surface of polishing pad 130, thereby helping to reduce defect formation on the surface of a wafer being polished. The debris and spent slurry are evacuated through channel segments 515, 516 between topside segments 519, 517 and topside segments 517, 518, respectively, in conditioning disk 500 of pad conditioner 60 by a vacuum module attached to pad conditioner 60. The inner channel in disk arm 210, hole 660 in disk holder 420 and middle plate 530, and gap 560 constitute an evacuation channel through which the spent slurry and debris entrapped in the grooves 515, 516 can be removed by the vacuum module during the in-situ conditioning of polishing pad 130. As a result, the scratching of the wafer surface caused by the polishing debris and spent slurry is reduced or eliminated.

Figure 8:
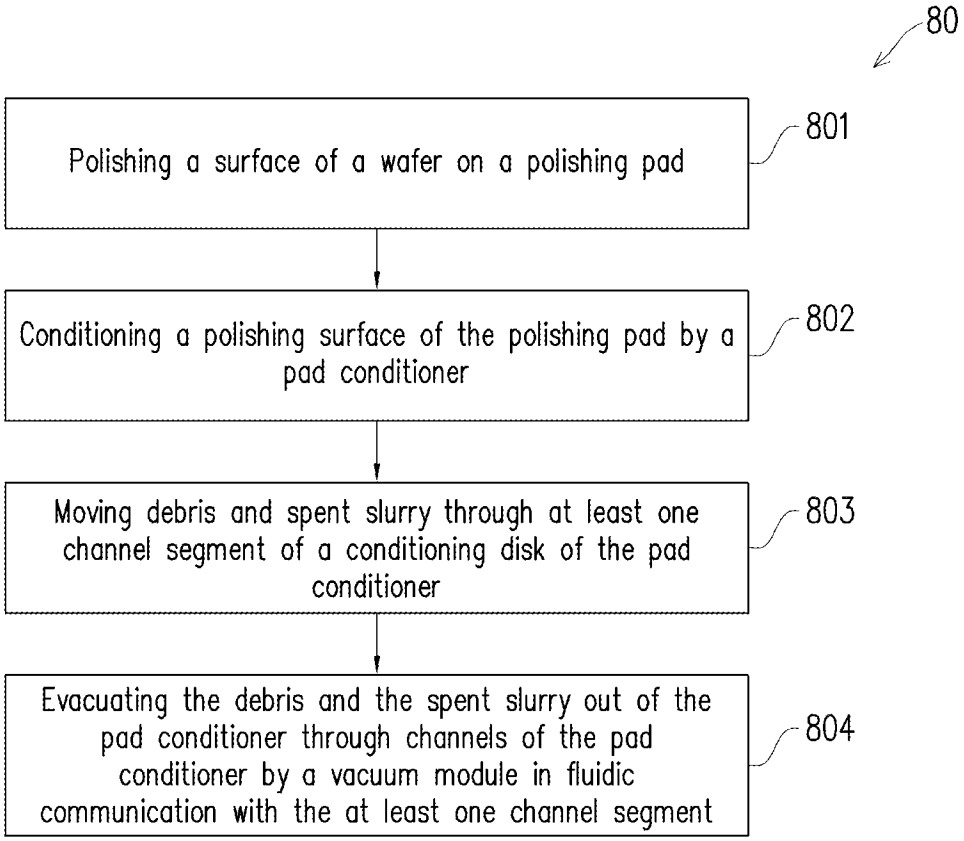
FIG. 8 is a flowchart of a method of conditioning a polishing pad in accordance with some embodiments.

FIG. 8 is a flowchart of a method of conditioning a polishing pad in accordance with some embodiments. The method may be described using the CMP device 10 of FIG. 1 and the pad conditioners 100, 40, 60, 80 of FIG. 2 to FIG. 8. Process 80 includes polishing 801 a surface of a wafer on polishing pad 130. In some embodiments, the wafer is held face down by wafer holder 110 against polishing pad 130 at a predetermined pressure. Polishing 801 is generally performed by polishing pad 130 in the presence of a slurry deposited on polishing pad 130 by slurry arm 120.

Process 80 further includes conditioning 802 a polishing surface of polishing pad 130 by a pad conditioner such as one of pad conditioners 40, 60, 80. In some embodiments, conditioning 802 is performed during polishing 801. In some embodiments, conditioning 802 is performed prior to polishing 801 or following polishing 801. In some embodiments, conditioning 802 is performed at predetermined time intervals during polishing 801. Conditioning 802 loosens debris from polishing pad 130 by action of at least two abrasive segments of pad conditioner 40, 60 or 100, such as abrasive segments 321, 327, or by action of non-segmented abrasive region 520. In some embodiments, loosening debris includes loosening abrasive particles of the slurry, ground off particles of the wafer, and/or abrasive particles of the abrasive segments, all of which may be attached to the polishing pad 130 or unattached and present in the slurry.

The debris and spent slurry are moved through at least one channel segment of the conditioning disk of the pad conditioner in moving 803. In some embodiments, the moving 803 is toward the hole 360 at the center of the substrate plate 310 through at least channel segment 323 by motion of conditioning disk 200. In some embodiments, the moving 803 is away from the center of substrate plate 510, upward along sidewalls of the substrate plate 510, and through at least channel segment 515 toward gap 560 between substrate plate 510 and middle plate 530 by motion of conditioning disk 500. In some embodiments, the moving 803 includes simultaneously toward the center of substrate plate and toward the perimeter of substrate plate.

The debris and spent slurry are evacuated out of the pad conditioner through channels of the pad conditioner by a vacuum module in fluidic communication with the at least one channel segment in evacuating 804. In some embodiments, evacuating 804 is through hole 360 and the inner channel of disk arm 210 and out from opening 211 of disk arm 210. In some embodiments, evacuating 804 is through gap 560, hole 660 and the inner channel of disk arm 210 and out from opening 211 of disk arm 210. In some embodiments, evacuating 804 includes through gap 560 and hole 860, and the inner channel of disk arm 210 and out from opening 211 of disk arm 210.

A pad conditioner configured to be used in an in-situ, ex-situ, or continuous-in-process ("CIP"), conditioning operation is provided. The pad conditioner allows continuously cleaning and evacuating debris and spent slurry from the polishing surface of a polishing pad, thereby helping to reduce defect formation on the surface of a wafer being polished. The debris and spent slurry are evacuated through at least one channel in a conditioning disk of the pad conditioner by a vacuum module attached to the pad conditioner. The conditioning disk includes at least one linear or non-linear channel segment between at least two abrasive segments. The channel segments collect debris and spent slurry to be evacuated by the vacuum module through a hole in the conditioning disk in fluid communication with an opening and inner channel of a disk arm to which the conditioning disk is attached.

In at least one embodiment, a pad conditioner comprises a conditioning disk, a disk holder, and a disk arm. The conditioning disk comprises a substrate plate having an outer rim, an abrasive region on a surface of the substrate plate, and at least one channel segment extending from about the center of the substrate plate to substantially the outer rim of the substrate plate. The disk holder to which the conditioning disk is mounted includes a through hole. The disk arm to which the conditioning disk is mounted includes an opening in fluid communication with the at least one channel segment via the through hole.

A method in accordance with various embodiments includes polishing a surface of a wafer on a polishing pad in the presence of a slurry. Conditioning of a polishing surface of the polishing pad is performed using a pad conditioner having a conditioning disk including a channel segment. Debris and spent slurry are moved from the polishing surface through the channel segment by motion of the conditioning disk. The debris and the spent slurry are evacuated via an opening of a disk arm in fluidic communication with the channel segment using a vacuum module.

In accordance with at least one embodiment, a pad conditioner comprises a conditioning disk, a disk holder, and a disk arm. The pad conditioner comprises a substrate plate having a first through hole and an outer rim, and an abrasive region attached to a surface of the substrate plate. The abrasive region includes at least two abrasive segments defining at least one channel segment therebetween. Each channel segment extends from the first through hole to substantially the outer rim of the substrate plate. The disk holder to which the conditioning disk is mounted includes a second through hole in fluid communication with the first through hole and the at least one channel segment. The disk arm to which the disk holder is attached includes an inner channel extending along a lengthwise direction of the disk arm and in fluidic communication with the second through hole in the disk holder.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A pad conditioner, comprising:

a conditioning disk including:

a substrate plate having an outer rim;

an abrasive region on a surface of the substrate plate; and at least one channel segment extending from about the center of the substrate plate to substantially the outer rim of the substrate plate;

a disk holder to which the conditioning disk is mounted, the disk holder including a through hole; and a disk arm to which the conditioning disk is mounted, the disk arm including an opening, the opening extending along a lengthwise direction of the disk arm, the opening being coupled to a vacuum module for evacuating debris and slurry through the at least one channel segment, the through hole and the opening, the opening being in fluid communication with the at least one channel segment via the through hole.

2. The pad conditioner of claim 1, wherein the substrate plate includes a through hole in fluid communication with the through hole of the disk holder and the at least one channel segment.

3. The pad conditioner of claim 2, wherein the at least one channel segment has non-linear shape.

4. The pad conditioner of claim 1, wherein the conditioning disk further comprises:

a middle plate attached to the disk holder and the substrate plate, wherein the middle plate surrounds the substrate plate and is separated from the substrate plate by a gap; and a retaining ring attached to the middle plate.

5. The pad conditioner of claim 4, wherein the at least one channel has substantially linear shape.

6. The pad conditioner of claim 1, wherein the at least one channel segment includes a groove in the abrasive region, and the abrasive region covers 50% to 90% of area of the surface of the substrate plate.

7. The pad conditioner of claim 1, wherein the at least one channel segment includes a groove in the abrasive region, and the surface of the substrate plate underlying the groove is covered by substantially no abrasive material.

8. The pad conditioner of claim 1, wherein the substrate plate has a first channel segment at a second surface of the substrate plate opposite the surface, the first channel segment being in fluidic communication with the inner channel, the second surface facing the disk holder.

9. The pad conditioner of claim 1, wherein the opening overlaps the through hole.

10. A method, comprising:

polishing a surface of a wafer on a polishing pad in the presence of a slurry;

conditioning a polishing surface of the polishing pad using a pad conditioner having a conditioning disk including a channel segment, the conditioning disk being mounted to a disk holder, the disk holder including a through hole;

moving debris and spent slurry from the polishing surface through the channel segment by motion of the conditioning disk; and evacuating the debris and the spent slurry via an opening of a disk arm, the opening extending along a lengthwise direction of the disk arm, the opening being in fluidic communication with the channel segment via the through hole, wherein the debris and the spent slurry are evacuated through the channel segment, the through hole and the opening.

11. The method of claim 10, wherein the moving the debris and the spent slurry includes:

moving the debris and the spent slurry toward a center hole of the substrate plate in fluid communication with the opening of the disk arm.

12. The method of claim 11, where the conditioning includes:

conditioning the polishing surface of the polishing pad using the pad conditioner having the conditioning disk including at least two abrasive segments forming the channel segment having non-linear shape.

13. The method of claim 10, wherein the moving the debris and the spent slurry includes:

moving the debris and the spent slurry toward a gap between the substrate plate and a middle plate to which the substrate plate is attached, the gap in fluidic communication with the opening of the disk arm through the channel segment.

14. The method of claim 13, where the performing conditioning includes:

performing conditioning of the polishing surface of the polishing pad using the pad conditioner having the conditioning disk including the channel segment in a topside of the substrate plate facing the middle plate, the channel segment having substantially linear shape.

15. The method of claim 10, wherein the evacuating the debris and the spent slurry is performed simultaneously with the polishing the surface of the wafer.

16. A pad conditioner, comprising:

a conditioning disk including:

a substrate plate having a first through hole and an outer rim; and an abrasive region attached to a first surface of the substrate plate, the abrasive region including at least two abrasive segments having at least one channel segment therebetween, each channel segment extending from the first through hole to substantially the outer rim of the substrate plate;

a disk holder to which the conditioning disk is mounted, the disk holder including a second through hole in fluid communication with the first through hole and the at least one channel segment; and a disk arm to which the disk holder is attached, the disk arm including an inner channel, the inner channel being coupled to a vacuum module for evacuating debris and slurry through the first through hole, the second through hole and the inner channel, the inner channel extending along a lengthwise direction of the disk arm and being in fluidic communication with the first through hole via the second through hole in the disk holder.

17. The pad conditioner of claim 16, wherein the at least one channel segment is extended in a radial direction.

18. The pad conditioner of claim 16, wherein the abrasive segments are wedge shaped.

19. The pad conditioner of claim 16, wherein the at least one channel segment occupies from 10% to 50% of the surface area of the first surface of the substrate plate.

20. The pad conditioner of claim 16, wherein the at least one channel segment has average radius of curvature greater than half the radius of the substrate plate.

* * * * *